US009254033B1

(12) United States Patent
Huang

(10) Patent No.: US 9,254,033 B1
(45) Date of Patent: Feb. 9, 2016

(54) TOOTHBRUSH HEAD

(71) Applicant: ACUMEN CO., LTD., New Taipei (TW)

(72) Inventor: Shou-Jen Huang, New Taipei (TW)

(73) Assignee: ACUMEN CO., LTD., New Taipei (TW)

( * ) Notice: Subject to any disclaimer, the term of this patent is extended or adjusted under 35 U.S.C. 154(b) by 0 days.

(21) Appl. No.: 14/702,801

(22) Filed: May 4, 2015

(30) Foreign Application Priority Data

Dec. 22, 2014 (TW) ..... 103222673 U

(51) Int. Cl.
*A46B 7/06* (2006.01)
*A46B 9/04* (2006.01)
*A46B 3/20* (2006.01)

(52) U.S. Cl.
CPC ... *A46B 9/04* (2013.01); *A46B 3/20* (2013.01); *A46B 7/06* (2013.01)

(58) Field of Classification Search
CPC ..... A46B 7/06; A46B 9/04
See application file for complete search history.

(56) References Cited

U.S. PATENT DOCUMENTS 5,350,219 A * 9/1994 Shou-Jen ..... 300/21
5,651,158 A * 7/1997 Halm ..... 15/167.1
6,219,874 B1 * 4/2001 van Gelder et al. ..... 15/167.1
6,230,356 B1 * 5/2001 Hyo-Moon ..... 15/167.1
6,810,551 B1 * 11/2004 Weihrauch ..... 15/167.1

* cited by examiner

*Primary Examiner* — Randall Chin
(74) *Attorney, Agent, or Firm* — Pai Patent & Trademark Law Firm; Chao-Chang David Pai

(57) ABSTRACT

The invention is related to a toothbrush head which comprises a head base, a head frame, and bristles. The head base comprises a front end, a back end, multiple strip-substrates, and multiple junctions. The multiple strip-substrates are aligned between the front end and the back end and each two adjacent strip-substrates link with each other with each of the multiple junctions, and each of the multiple strip-substrates comprises multiple sockets for inserting the bristles. The head frame comprises a bottom surface and multiple accommodating spaces for accommodating the head base. The toothbrush head allows the bristles to be bent into the arc shape when touching the teeth, so as to increase touching areas between the brushes and the teeth for enhancing cleaning effect and decreasing risks of causing caries.

6 Claims, 4 Drawing Sheets

TOOTHBRUSH HEAD

BACKGROUND OF THE INVENTION

1. Field of the Invention

The present invention relates to a toothbrush head, especially to a toothbrush head comprising a head base made of a rigid material and a head frame made of a soft material.

2. Description of the Prior Art

The conventional toothbrush head comprises a rigid substrate with multiple sockets and bristles, wherein the bristles are inserted in the sockets of the rigid substrate. As a user brushes his teeth with the conventional toothbrush head, the bristles are inflexible when touching the teeth. Crevices between the teeth therefore cannot be cleaned by the bristles of the conventional toothbrush head, which results into growth of bacteria and lesions on the teeth.

To overcome the shortcomings, the present invention provides a toothbrush head to mitigate or obviate the aforementioned problems.

SUMMARY OF THE INVENTION

The main objective of the invention is to provide a toothbrush head that can effectively increase touching area of the teeth surface between the bristles and the teeth, and increase the cleaning effect.

The toothbrush head in accordance with the present invention has a head base made of a rigid material, a head frame made a soft material, and bristles.

The head base comprises a central part, a front end, a back end opposite to the front end, multiple strip-substrates, multiple junctions, a bottom surface and a rim. The central part is positioned between the front end and the back end. Each of the multiple strip-substrates comprises multiple sockets for inserting the bristles, and the strip-substrates are aligned between the front end and the back end of the head base. Each two adjacent strip-substrates link with each other with each of the multiple junctions. The bottom surface and the rim are positioned respectively at bottoms of the multiple strip-substrates and surrounding of the multiple strip-substrates.

The head frame is formed between each of the multiple strip-substrates and on the bottom surface and the rim of the head base by the overmolding technique or 3D printing technique, allowing the toothbrush head to be made of two different materials. The head base is made of a rigid material, and the head frame is made of a soft material.

As a user brushes his teeth with the toothbrush head, the head frame applies pressures on the basal end of the bristles, allowing the bristles to be easily bent into arc shape while touching the teeth. The present invention helps the user to brush his teeth with slight pressure to protect the teeth and the gingival, and increases touching areas between the brushes and the teeth to enhance cleaning effect to the teeth. Besides, the soft material of the head frame helps to protect the gingival from injury caused by touching the gingival by the toothbrush head with excess force during tooth brushing.

DETAILED DESCRIPTION OF THE PREFERRED EMBODIMENTS

Embodiment 1

Figure 1A:
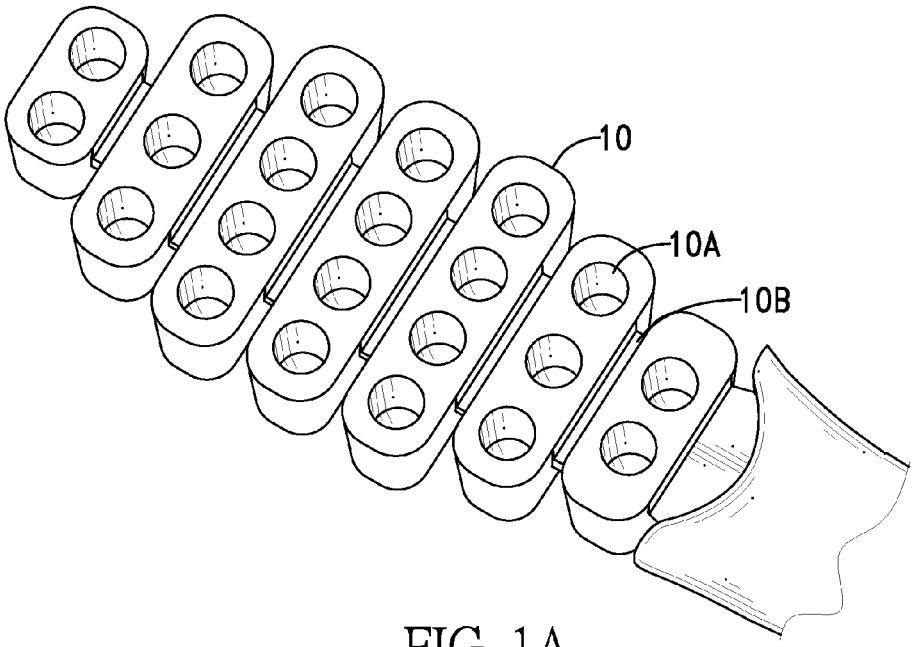
FIG. 1A is a perspective view of a head base of a toothbrush head in accordance with the present invention.
Figure 1B:
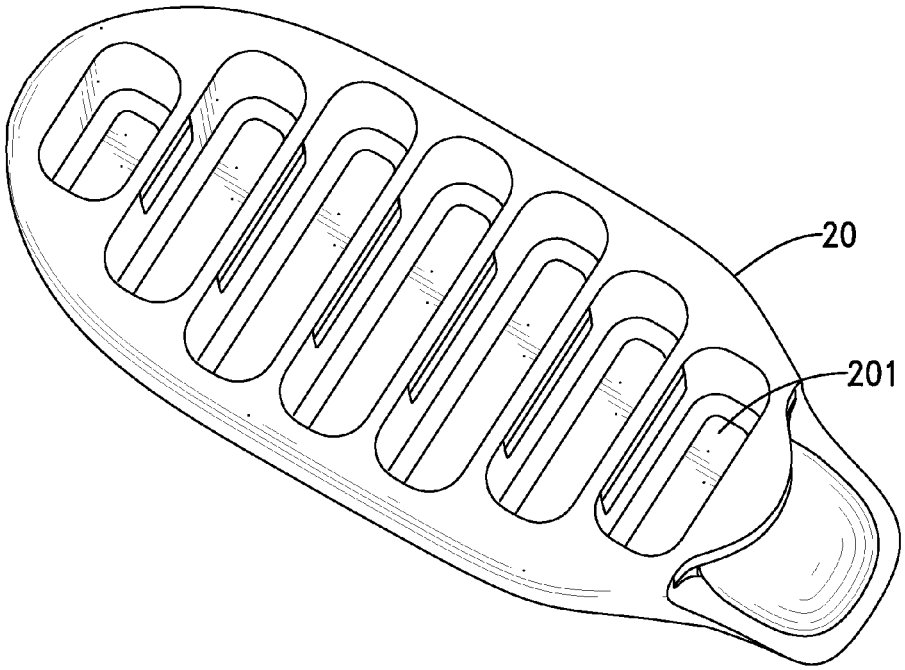
FIG. 1B is a perspective view of a head frame of the toothbrush head in accordance with the present invention.
Figure 2:
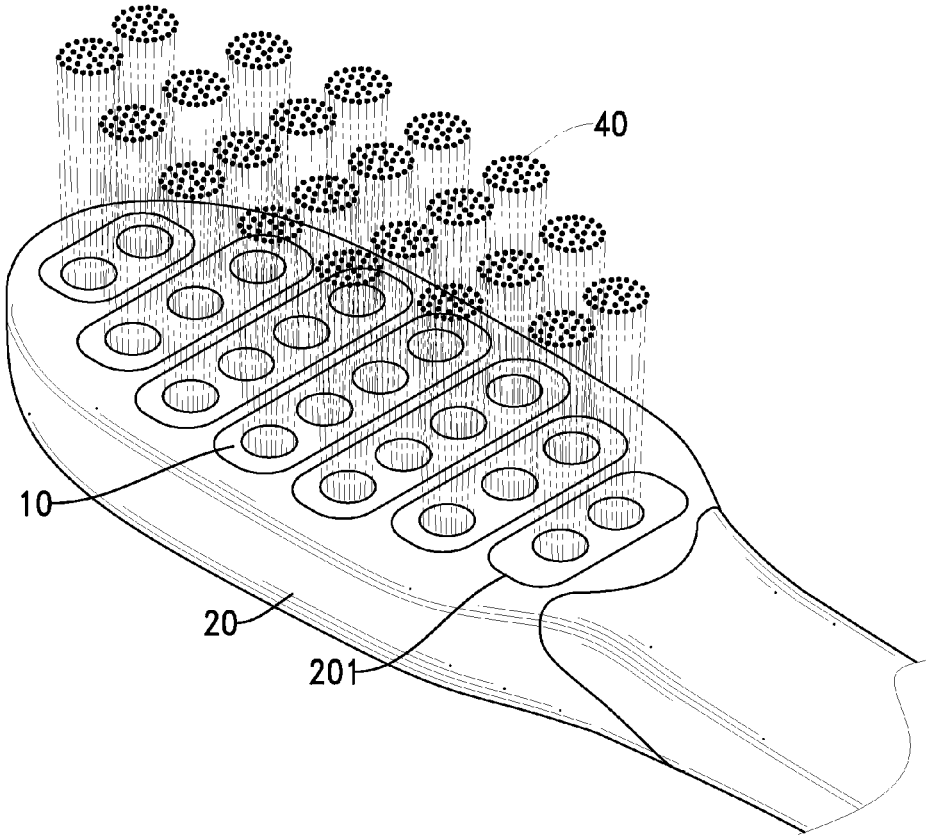
FIG. 2 is a perspective view of the toothbrush head in accordance with the present invention.

With references to FIG. 1A, FIG. 1B and FIG. 2, a toothbrush head in accordance with the present invention in Embodiment 1 comprises a head base 10, a head frame 20, and bristles 40.

Figure 3:
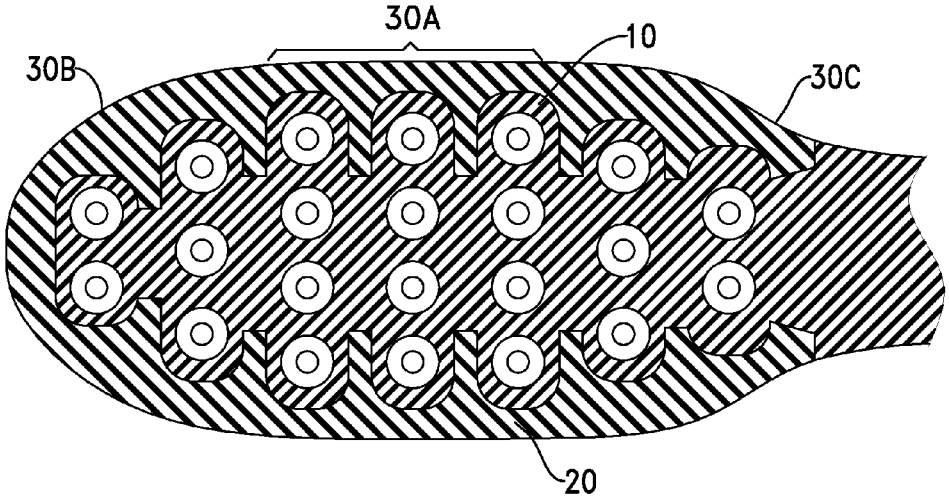
FIG. 3 is a side-sectional view of the toothbrush head in FIG. 2.

With references to FIG. 1A, FIG. 1B and FIG. 3, the head base 10 comprises a central part 30A, a front end 30B, a back end 30C opposite to the front end 30B, multiple strip-substrates, multiple junctions 10B, a bottom surface, and a rim. The central part 30A is positioned between the front end 30B and the back end 30C. Each of the multiple strip-substrates comprises multiple sockets 10A for inserting the bristles 40. The number of the multiple strip-substrates in Embodiment 1 is seven. The multiple strip-substrates are aligned between the front end 30B and the back end 30C of the head base 10 and each two adjacent strip-substrates link with each other with each of the multiple junctions 10B. A shape of each of the multiple sockets 10A is, but not limited to, circle, polygon, cross, star, heart-shape or elliptical shape. The bottom surface and the rim are positioned respectively at bottoms and surrounding of the multiple strip-substrates.

Figure 4:
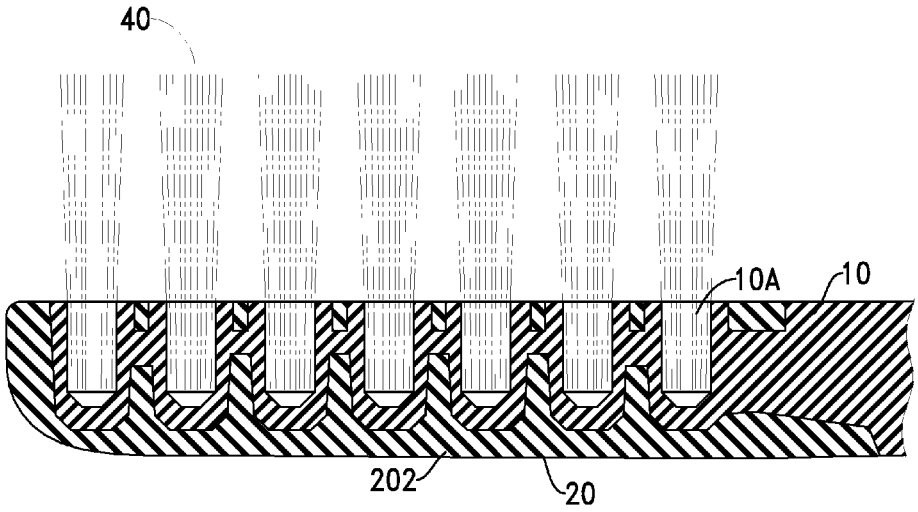
FIG. 4 is another side-sectional view of the toothbrush head in FIG. 2.

With references to FIG. 1A, FIG. 1B and FIG. 4, the head frame 20 comprises multiple accommodating spaces 201 and a basal plane 202. The multiple accommodating spaces 201 accommodate the head base 10. With reference to FIG. 3, the head base 10 comprises an extension direction. The extension direction extends along the front end 30B and the back end 30C of the head base 10. Three of the multiple strip-substrates positioned at the central part 30A of the head base 10 are defined as central strip-substrates. Each of the multiple strip-substrates has a width perpendicular to the extension direction of the head base 10. The width of each of the multiple strip-substrates decreases gradually from the central strip-substrates at the central part 30A of the head base 10 to the front end 30B and the back end 30C of the head base 10, respectively. Specifically, the central strip-substrates at the central part 30A of the head base 10 comprises the biggest width, and the width of each of the multiple strip-substrates aligned outside of the central strip-substrates and close to the front end 30B or the back end 30C of the head base 10 is smaller than the width of the central strip-substrates of the head base 10.

Figure 5:
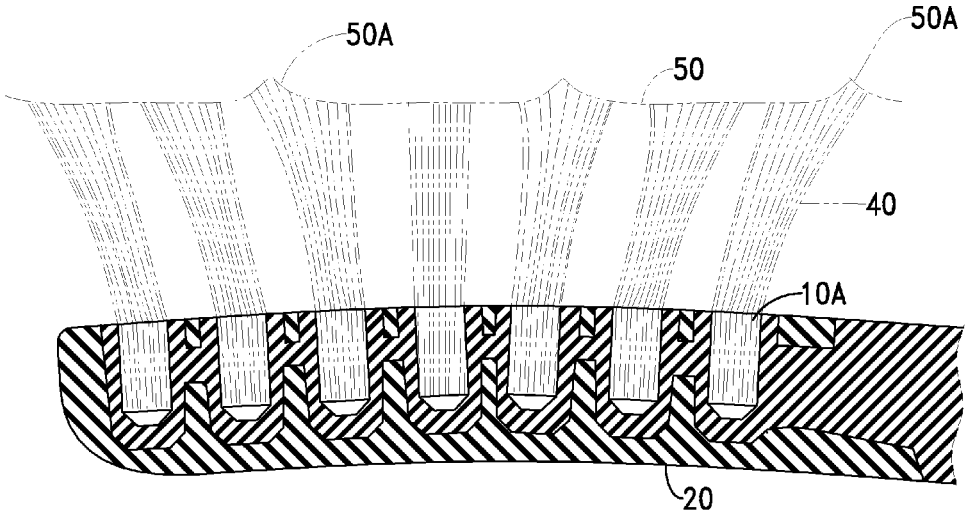
FIG. 5 is a side-sectional view of the toothbrush head in FIG. 2, shown in use.

With references to FIG. 4 and FIG. 5, the bristles 40 are inserted into the multiple sockets 10A of the head base 10 after the head frame 20 is formed outside of the head base 10. With references to FIG. 3 and FIG. 5, as a user brushes his teeth with the toothbrush head of the present invention, tops of the bristles 40 positioned in the central part 30A of the head base 10 can perpendicularly touch the teeth for cleaning. Then, the head frame 20 provides a pressure on the head base 10, allowing the head base 10 together with the head frame 20 to be bent into the arc shape. As such, the bristles 40 inserted in the multiple sockets 10A of each of the multiple strip-substrates at the front end 30B and the back end 30C of the head base 10 are able to bend into the arc shape. The tops of the bristles 40 bent in the arc shape can touch the teeth 50 and crevices 50A between the teeth 50, so as to increase touching areas between the brushes 40 and the teeth 50 for enhancing cleaning effect and decreasing risks of causing caries.

Embodiment 2

With reference to FIG. 5, in Embodiment 2, the head base 10 and the head frame 20 are made of two different materials. The head base 10 is made of a rigid plastic material, whereas the head frame 20 is made of a soft plastic material, formed between each of the multiple strip-substrates and on the bottom surface and the rim of the head base 10 by overmolding technique or 3D printing technique. The soft material of the head frame 20 helps to protect the gingival from injury caused by touching the gingival by the toothbrush head with excess force during tooth brushing.

Embodiment 3

A toothbrush head in accordance with the present invention in Embodiment 3 is similar to Embodiment 1. The difference between Embodiment 3 and Embodiment 1 is the structure of the head base.

The head base in Embodiment 3 comprises a central part, a first lateral side, a second lateral side, multiple strip-substrates, and multiple junctions. The central part is positioned between the first lateral side and the second lateral side. Each of the multiple strip-substrates comprises an axial length in the same direction as the extension direction of the head base, and the multiple strip-substrates are aligned between the first lateral side and the second lateral side of the head base, and each two adjacent strip-substrates link with each other with each of the multiple junctions.

Some of the multiple strip-substrates positioned at the central part of the head base are defined as central strip-substrates. Each of the multiple strip-substrates has a width parallel to the extension direction of the head base. The width of each of the multiple strip-substrates decreases gradually from the central strip-substrates at the central part of the head base to the first lateral side and the second lateral side of the head base, respectively. Specifically, the central strip-substrates at the central part of the head base comprise the biggest width, and the width of each of the multiple strip-substrates aligned outside of the central strip-substrates and close to the first lateral side or the second lateral side of the head base is smaller than the width of the central strip-substrates of the head base.

The beneficial effect of the toothbrush head in Embodiment 3 is similar to Embodiment 1 and Embodiment 2.

As a user brushes his teeth with the toothbrush head of the present invention, the tops of bristles positioned in the central part of the head base can perpendicularly touch the teeth for cleaning. Then, a head frame formed outside of the head base applies a pressure on the head base, allowing the head base together with the head frame to be bent into the arc shape. As such, the bristles inserted in each of the multiple strip-substrates positioned at the first lateral side and the second lateral side of the head base are able to bend into the arc shape. The top of the bristles bent into the arc shape can touch the teeth and crevices between the teeth, so as to increase touching areas between the brushes and the teeth for enhancing cleaning effect and decreasing risks of causing caries.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A toothbrush head comprising:

a head base comprising:

a front end;

a back end opposite to the front end;

a central part positioned between the front end and the back end;

an extension direction along the front end and the back end;

a right lateral side connecting to the front end and the back end;

a left lateral side opposite to the right lateral side and connecting the front end and the back end;

multiple strip-substrates positioned between the front end and the back end, as well as between the right lateral side and the left lateral side, wherein each of the multiple strip-substrates has a width perpendicular to the extension direction of the head base, wherein the width of each of the multiple strip-substrates decreases gradually from the central part of the head base to the front end and the back end of the head base, respectively;

multiple sockets positioned on each of the multiple strip-substrates;

multiple junctions, wherein each of the multiple junctions links two of the multiple strip-substrates adjacent with each other;

a bottom surface positioned at bottoms of the multiple strip-substrates; and a rim surrounding the multiple strip-substrates;

a head frame comprising multiple accommodating spaces, wherein the multiple accommodating spaces accommodate the head base; and bristles inserted into each of the multiple sockets.

2. The toothbrush head as claimed in claim 1, the head base being composed of seven strip-substrates.

3. The toothbrush head as claimed in claim 1, the multiple sockets of the head base having a shape selected from the group consisting of circle, polygon, cross, star, heart and ellipse.

4. The toothbrush head as claimed in claim 1, wherein the head frame is formed between each of the multiple strip-substrates and on the bottom surface and the rim of the head base.

5. The toothbrush head as claimed in claim 4, wherein the head base is composed of a rigid material.

6. The toothbrush head as claimed in claim 5, wherein the head frame is composed of a soft material.

* * * * *